US009567532B2

(12) United States Patent
Tsebulaev et al.

(10) Patent No.: US 9,567,532 B2
(45) Date of Patent: Feb. 14, 2017

(54) METHOD FOR PRODUCING NON-CARCINOGENIC AROMATIC PROCESS OIL

(71) Applicants: Victor Alekseevich Tsebulaev, Novgorod (RU); Nikolay Vladimirovich Khodov, Novgorod (RU); Andrey Fedorovich Kuimov, Volodarsk (RU); Arkadiy Benyuminovich Radbil, Novgorod (RU); Taras Ivanovich Dolinskiy, Novgorod (RU); Oleg Anatolyevich Mazurin, Novokuybyshevsk (RU)

(72) Inventors: Victor Alekseevich Tsebulaev, Novgorod (RU); Nikolay Vladimirovich Khodov, Novgorod (RU); Andrey Fedorovich Kuimov, Volodarsk (RU); Arkadiy Benyuminovich Radbil, Novgorod (RU); Taras Ivanovich Dolinskiy, Novgorod (RU); Oleg Anatolyevich Mazurin, Novokuybyshevsk (RU)

(73) Assignee: ORGKHIM BIOCHEMICAL HOLDING MANAGEMENT COMPANY, JOINT STOCK COMPANY (ORGKHIM BCH MANAGEMENT COMPANY, JSC), Nizhny Novgorod (RU)

( * ) Notice: Subject to any disclaimer, the term of this patent is extended or adjusted under 35 U.S.C. 154(b) by 0 days.

(21) Appl. No.: 14/427,798

(22) PCT Filed: Oct. 9, 2012

(86) PCT No.: PCT/RU2012/000815
§ 371 (c)(1),
(2) Date: May 7, 2015

(87) PCT Pub. No.: WO2014/058333
PCT Pub. Date: Apr. 17, 2014

(65) Prior Publication Data
US 2016/0002543 A1 Jan. 7, 2016

(51) Int. Cl.
*C10G 21/12* (2006.01)
*C10G 21/20* (2006.01)
(Continued)

(52) U.S. Cl.
CPC ..... *C10G 29/28* (2013.01); *C10G 21/02* (2013.01); *C10G 21/16* (2013.01); *C10G 21/20* (2013.01);
(Continued)

(58) Field of Classification Search
CPC ..... C10G 21/00; C10G 21/12; C10G 21/20; C10G 21/22; B01D 11/00; B01D 11/04
See application file for complete search history.

(56) References Cited

U.S. PATENT DOCUMENTS

| | | | |
|---|---|---|---|
| 5,045,206 | A | 9/1991 | Chen et al. |
| 6,802,960 | B1 | 10/2004 | Davies et al. |
| 2011/0073528 | A1 | 3/2011 | Osaheni et al. |

FOREIGN PATENT DOCUMENTS

| | | |
|---|---|---|
| BY | 7326 | 9/2005 |
| CN | 101870886 | 10/2010 |

(Continued)

OTHER PUBLICATIONS

English translation of Grushova et al (BY 7326 C1), published Sep. 30, 2005, 7 pages.*

(Continued)

*Primary Examiner* — Brian McCaig
(74) *Attorney, Agent, or Firm* — Ladas & Parry LLP

(57) ABSTRACT

The present invention relates to the chemical or petroleum-processing industry and can be used in the production of
(Continued)

petroleum plasticizers for synthetic rubber and tyres. In the method for producing non-carcinogenic aromatic process oil, containing a PCA extract of less than 3.0% according to the IP-346 method, said method comprising purifying the oil fractions of petroleum with selective solvents and separating the extract, additionally processing the extract with a polar solvent and producing a raffinate as the end product, the polar solvent used is a mixture of dimethylsulphoxide and Nmethylpyrrolidone, which is used for preliminary processing of the extract, wherein, after the preliminary processing, the mixture of extract and polar solvent is filtered, divided and the light phase is sent to the additional processing of the extract with the polar solvent, and the heavy phase is sent to a polar solvent regeneration stage. The ratio of dimethylsulphoxide to N-methylpyrrolidone in the mixture is within the range of 1:0.1-0.5. The ratio of polar solvent to extract in the additional processing stage is within the range of 1.5-2.5:1. The ratio of polar solvent to extract in the preliminary processing stage is within the range of 0.1-0.3:1. The technical result consists in increasing the efficiency of the process by preventing the formation of an intermediate layer in the extractor column, by reducing the ratio of solvent:extract, and, as a consequence, by increasing the productivity of the plant, simplifying the process of drying the solvent, and eliminating a paraffin-naphthene solvent, which substantially simplifies the regeneration of extractant from the raffinate solution.

3 Claims, 1 Drawing Sheet

(51) Int. Cl.

| | |
|---|---|
| ***C10G 21/22*** | (2006.01) |
| ***C10G 29/28*** | (2006.01) |
| ***C10G 21/16*** | (2006.01) |
| ***C10G 21/28*** | (2006.01) |
| ***C10G 21/02*** | (2006.01) |
| ***C10G 29/20*** | (2006.01) |
| *C10G 21/00* | (2006.01) |
| *B01D 11/00* | (2006.01) |
| *B01D 11/04* | (2006.01) |
| *C10C 3/08* | (2006.01) |

(52) U.S. Cl.
CPC ..... *C10G 21/22* (2013.01); *C10G 21/28* (2013.01); *C10G 29/20* (2013.01)

(56) References Cited

FOREIGN PATENT DOCUMENTS

| | | | |
|---|---|---|---|
| CN | 102140369 | A | 8/2011 |
| DE | 60013106 | D | 9/2004 |
| EA | 010590 | B1 | 10/2008 |
| EP | 0417980 | | 3/1991 |
| EP | 1 106 673 | A2 | 6/2001 |
| EP | 1165724 | B1 | 8/2004 |
| JP | 2000-63849 | A | 2/2000 |
| JP | 2004323544 | | 11/2004 |
| RU | 2279466 | | 7/2006 |
| RU | 2313562 | | 12/2007 |
| WO | 2011/145086 | A2 | 11/2011 |

OTHER PUBLICATIONS

English Abstract of RU2279466, Jul. 10, 2006.
English Abstract of CN101870886, Oct. 27, 2010.
English Abstract of JP2004323544, Nov. 18, 2004.
English Abstract of RU2313562, Dec. 27, 2007.
Search Report dated May 13, 2015 for Singapore Application No. 11201406859X.
espacenet English abstract of EA 010590 B1.
espacenet English abstract of CN 102140369 A.
espacenet English abstract of JP 2000-63849 A.

* cited by examiner

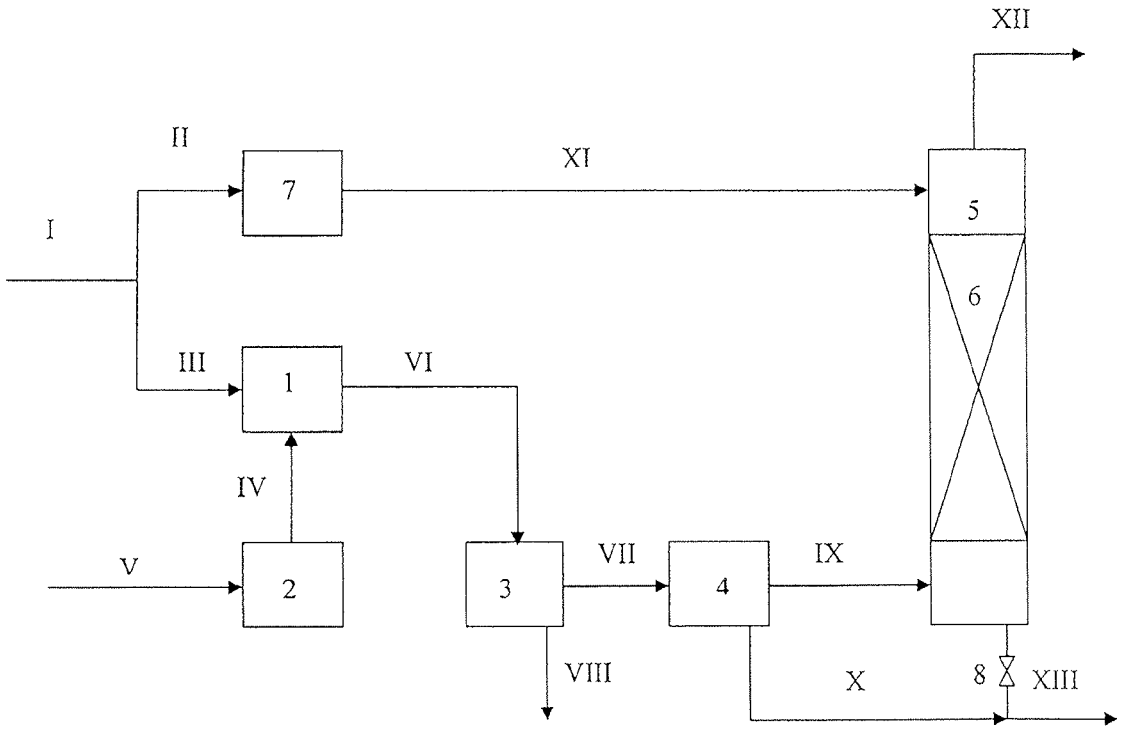
XII
II
XI
7
5
I
6
III
1
VI
IV
V
2
3
VII
4
IX
VIII
X
8
XIII

METHOD FOR PRODUCING NON-CARCINOGENIC AROMATIC PROCESS OIL

RELATED APPLICATION

This application is a national phase entry under 35 USC 371 of International Patent Application No. PCT/RU2012/000815 filed on Oct. 9, 2012, the disclosures of which are incorporated in their entirety by reference herein.

FIELD OF THE INVENTION

The present invention relates to chemical or petroleum refining industry and can be used in producing petroleum plasticizers of synthetic rubber and tires.

BACKGROUND OF THE INVENTION in accordance with Directive 2005/69/EU of the European Parliament and the European Council of 16 Nov. 2005, petroleum plasticizer oils cannot come on the market and be used in the production of tires and their components in the EU since Jan. 1, 2010, if they contain more than 3.0% PCA determined according to the IP-346:1998 method.

Process oils (plasticizers) for butadiene-styrene rubbers and tires having a high content of aromatic hydrocarbons (the content of aromatic carbon more than 25% according to ASTM D 2140) is produced by the method of refining extracts of petroleum oil fractions with selective solvents.

In view of the increased consumption of such plasticizers it is necessary to increase the plant capacity, as well as to improve environmental safety and reduce the energy consumption and other resources for their production.

The currently existing methods of solvent refining of extracts of petroleum oil fractions do not take into account the presence in the extracts of condensed high carbon compounds (carbenes, carboids and the likes), actually insoluble in the majority of known solvents. Such compounds may be present in feed provided at extraction or be formed from using high temperatures in the step of stripping solvents from extraction solutions during the production of extracts, as extracts contain the largest number of reactive compounds (for example, olefins). Insoluble impurities negatively influence the extraction process and decrease the efficiency of operation of plants for producing high aromatic plasticizers. Also there is a need for choosing more selective solvents in order to reduce the number of extracts having a high content of carcinogenic aromatic hydrocarbons.

EP 0417980 is used furfurol as a selective solvent. The refining process is characterized by a low yield of final product (60-70%), low selectivity, inasmuch as furfurol dissolves not only polycyclic but also non-carcinogenic aromatic compounds.

A disadvantage of the known process is the use of a toxic solvent (furfurol) which is also has a high oxidation and resin formation capability.

Known is a method of producing process oils by the two-step extraction method described in DE60013106D.

As a selective solvent furfurol, phenol, N-methylpyrrolidone are used.

A disadvantage of the known process is complexity of the process and toxicity of solvents.

As a polar solvent the use of dimethyl sulphoxide (DMSO) is preferable.

Dimethyl sulphoxide differs from other polar solvents in greater selectivity (correspondingly, the final product yield increases), low toxicity (relates to hazard class 4—a low hazard substance), does not form azeotropic mixtures with water (the process of drying a solvent from water is simplified). The boiling point of dimethyl sulphoxide is at an atmosphere pressure of +189° C., the melting point is +18° C. It is widely used in medicine (cf. "Chemical encyclopedia", Vol. 2, Moscow. "Sovetskaya entsyclopedia", 1990, p. 64).

DSMO in all ratios is mixed with aromatic hydrocarbons having no long side chains, and actually does not dissolve paraffin hydrocarbons—this explains its high selectivity towards polycyclic aromatic hydrocarbons and high yield of refined petroleum in refining petroleum extracts.

RU 2313562, cl. C10G21/22, C08K11/00 published on 27 Dec. 2007 is described a process for producing a plasticizer and a plasticizer using dimethyl sulphoxide as an extraction solvent (closest prior art).

The essence of RU 2313562 is in that an extract of refining petroleum oil fractions with selective solvents is treated with dimethyl sulphoxide wherein the dimethyl sulphoxide:extract weight ratio is 2.0-4.0:1 and a temperature range is 30-120° C., and the resulted refined petroleum is used as a desired product. Preferably, the extract is preliminarily diluted with a paraffin-naphthene solvent with a solvent:extract weight ratio of 0.1-0.5:1. The extract is a residual extract and a mixture of residual and distillate extracts.

The invention allows producing a non-carcinogenic aromatic process oil by reducing the content of carcinogenic polycyclic aromatic compounds.

A disadvantage of above process is the use of a paraffin-naphthene solvent which is a highly inflammable liquid reducing thereby the fire-explosion hazard of the process.

Also, the use of a paraffin-naphthene solvent requires lowering the process temperature resulting thereby in increasing the selective solvent:feed ratio and rising energy demands for regenerating the solvent from extraction solutions. Another disadvantage is a hard constraint of water content in the selective solvent—not more than 1%. When a content of water is higher the dissolving capability of dimethyl sulphoxide reduces resulting thereby in increasing the content of carcinogenic polycyclic aromatic compounds. Drying dimethyl sulphoxide to the water content of less than 1% requires for great energy consumption and complicated rectifying equipment.

At the same time at the phase interface level an intermediate layer of insoluble impurities is formed that gradually block the column section resulting thereby in lowering the operation efficiency of the extraction column and breakdown of pump units.

Also these mixtures are partially took away with an extraction solution to evaporating apparatuses wherein the solvent regeneration takes place leading to surface contamination of heat exchanging devices, and as a consequence, a malfunction of evaporators.

SUMMARY OF THE INVENTION

The object of the invention is to provide a new more efficient method for producing non-carcinogenic aromatic process oil having a high content of aromatic hydrocarbons (more than 75%) and a low content of carcinogenic, mutagenic, and toxic substances. The technical effect of the invention consists in increasing the efficiency of the process by excluding the formation of an intermediate layer in an extraction column, reducing the solvent:extract ratio and, as a consequence, improving the plant capacity, simplifying the solvent drying process, refusal of a paraffin-naphthene solvent thereby essentially simplifying the extractant regeneration from a raffinate solution.

Said object is accomplished by that in the process for producing non-carcinogenic aromatic process oil containing less than 3.0% of a PCA extract according to the IP-346 method, said process comprising the steps of refining petroleum oil fractions with selective solvents and separating an extract, additional processing of the extract with a polar solvent and producing a raffinate as a desired product; a mixture of dimethyl sulphoxide and N-methylpyrrolidone is used as a polar solvent, the extract is pretreated with said mixture, and, after the pretreatment, a mixture of the extract and polar solvent is filtered, separated, and the light fraction is directed to additional treatment of the extract with a polar solvent, and the heavy fraction is directed to a step of regeneration of the polar solvent.

The ratio of dimethyl sulphoxide and N-methylpyrrolidone in the mixture is in the range of from 1:0.1 to 0.5.

The ratio of the polar solvent and the extract in the step of additional treatment is in the range of from 1.5 to 2.5:1.

The ratio of the polar solvent and the extract in the step of pretreatment is in the range of from 0.1 to 0.3:1.

N-methylpyrrolidone (1-methyl-2-pyrrolidone; N-methyl-γ-butyrolactam), the molecular weight is 99.13; colorless liquid, melting point is 24° C., boiling point is 206° C.; 82-84° C./10 mm of mercury; $d^{20}_{4}$ 1.0328; $n_D^{20}$ 1.4684; freely soluble in water, alcohols, acetone, benzene, xylene.

N-methylpyrrolidone is low toxic; the cumulative properties are mild; biodegradability is high.

N-methylpyrrolidone is used in the processes of refining petroleum oil fractions from aromatic hydrocarbon and resins in producing naphthene type oils.

The above and other aspects and advantages of the present invention are disclosed in the following detailed description thereof given referring to the drawing figure in which a plant for producing non-carcinogenic aromatic process oil is illustrated.

DETAILED DESCRIPTION OF THE INVENTION AND BRIEF DESCRIPTION OF THE DRAWINGS

A plant for producing non-carcinogenic aromatic process oil consists of a mixer 1 connected to a heat exchanger 2 and filter 3. The filter 3 is connected to a phase separator 4 connected to the bottom of extraction column 5 provided with a contact device 6. The top of extraction column 5 is connected to a heat exchanger 7. In the bottom of the column an interface level controller 8 is installed.

The method for producing non-carcinogenic aromatic process oil is carried out as follows. By refining petroleum oil fractions and deasphaltizate with polar solvents—phenols, N-methylpyrrolidone or furfurol by the known methods extracts—residual and distillate ones are recovered.

The selective refining extract of petroleum oil fractions in a stream (V) through the heat exchanger 2 is directed in a stream (IV) to the mixer 1 for pretreatment. In the heat exchanger 2 the extract is heated by the known methods to the desired temperature (70-110° C.). A polar solvent—a mixture of dimethyl sulphoxide and N-methylpyrrolidone in the weight ratio of from 1:0.1 to 0.5 is directed to the mixture in a stream (III). The ratio of the polar solvent and the extract in the pretreatment step is in the range of from 0.1 to 0.3:1. Mixing carries out at a temperature of the column bottom equal to 70-110° C. The mixture may be chosen from standard industrially manufactured mixing devices providing sufficiently mixing petroleum extracts and polar solvents. From contacting an extract and polar solvent at the phase interface boundary coagulation (flotation) of very small inclusions of high carbon compounds and contaminations of mineral origin into larger particles takes place. Further the mixture of the extract and polar solvent in a stream (VI) is directed to the filter 3, wherein the separation of particles formed by mixing takes place. Filtering is carried out by the known methods providing the recovery of solid particles having a size less than 20 μm, at a preferably temperature of 70-110° C. The filtrate in a stream (VIII) is periodically removed from the filter by the known methods and is directed to bitumen. Further the filtered mixture of the extract and polar solvent in a stream (VII) is provided to the separation to the phase separator 4 to produce a light phase (a partially refined petroleum oil fraction extract) and a heavy phase (an extraction solution). The phase separator 4 may be chosen from industrially manufactured gravity separators, centrifugal separators and liquid separators of other types providing sufficiently separating the light and heavy phases. The light phase in a stream (IX) is directed to the bottom of the extraction column 5 to additional treatment, the heavy phase in a stream (X) is directed to the step of regenerating the polar solvent. The extraction column 5 comprises a contact device 6 provided by the known method (disc rotor or regular packing, or dumped packing) to provide the efficient weight exchange and has gravity zones in the bottom and top to separate the light (raffinate) and heavy (extraction) phases. The column diameter and height depend on the desired capacity and number of theoretical plates to allow the best separation of components of the original extract.

To the top of the extraction column 5 through the heat exchanger 7 in a stream (XI) a mixture of dimethyl sulphoxide and N-methylpyrrolidone in the weight ratio of 1:0.1 to 0.5 is fed. In the heat exchanger 7 the solvent mixture is heated to the temperature allowing temperatures at the top of column 5 within the range of from 80 to 120° C., the temperature of the column 5 bottom is 70-110° C. The ratio of polar solvent and extract in the additional treatment step is in the range of 1.5 to 2.5:1.

From the bottom of the column 5 through the phase interface controller 8 in a stream (XIII) an extraction solution containing dimethyl sulphoxide, N-methylpyrrolidone, polycyclic aromatic hydrocarbons, resins and asphaltenes is withdrawn. From the top of the column in a stream XII a raffinate solution containing refined petroleum, N-methylpyrrolidone and dimethyl sulphoxide escapes. On completing the process the solvents are separated from the raffinate and extract by the known methods (underpressure distillation, reextraction). The raffinate is used as a process oil (plasticizer). The extract may be used as a component of fuel oil, in the production of bitumen and for some other purposes.

As a polar solvent a mixture of dimethyl sulphoxide and N-methylpyrrolidone in the weight ratio of from 1:0.1 to 0.5 is used.

EXAMPLE 1

Comparative

For extraction a column consisting of two glass shells having a diameter of 25 mm filled with a metal packing was used and having heating and cooling jackets.

The temperature in the column was maintained by means of two thermostats one of which heated the upper heat exchanger and the upper shell, the other one—the lower shell and the lower heat exchanger.

The extract obtained by solvent refining deasphaltizate with phenol containing 8.9% polycyclic aromatic hydrocarbons (PCA) according to the IP-346 method and 33.5% of aromatic carbon $C_a$ was fed by a dosing pump through the heat exchanger to the bottom of the extraction column. dimethyl sulphoxide (DMSO) was provided by a dosing pump through the heat exchanger to the top of the extraction column in the DMSO:extract weight ratio of 2.0:1. The temperature at the top of the column was 115° C., at the bottom of the column—100° C.

From the bottom of the column a raffinate solution containing refined petroleum and DMSO was withdrawn. From the bottom of the column through the phase interface controller an extraction solution containing DMSO, an extract of PCA and resins was withdrawn. At the phase interface level gradual accumulation of the intermediate layer is noticeable, the operation regime of the column is broken, the quality of refined petroleum degrades, that is why the dosages of the extract and DMSO had to be lowered by 30% for a month.

After stripping the solvents refined petroleum used as a plasticizer, and the extract containing PCA with three and more aromatic rings and resins which is a side product are produced. The produced non-carcinogenic aromatic process oil was analyzed for the content of a PCA extract and the content of aromatic carbon $C_a$.

The content of the PCA extract was determined by the IP-346 method. The determination is carried out by extracting an oil sample dissolved in cyclohexane with dimethyl sulphoxide followed by recovering PCA from the solution by means of cyclohexane and 4% aqueous sodium chloride solution and stripping cyclohexane from PCA by a rotary evaporator.

The content of aromatic carbon $C_a$ was determined by the ASTM D 2140 method. The method consists in measuring the refraction index at 20° C., density at 20° C., and kinematic viscosity at 37.8° C. Further, according to the obtained measuring results the refraction intercept and weight-viscosity constant are calculated. Then according to the refraction intercept and weight-viscosity constant values on a diagram the content of aromatic carbon $C_a$ is determined.

The properties of the produced non-carcinogenic aromatic process oil are given in Table 1.

EXAMPLE 2

In a cylindrical apparatus with a stirrer and heating jacket at a temperature of 100° C. for 30 min there was mixed 3000 g of extract (the kinematic viscosity at 100° C. according to the ASTM D 445 is 21.6 $mm^2/s$, the content of the PCA extract according to the IP-346 method is 8.9%, the content of aromatic carbon $C_a$ is 33.5%) and 600 g of a mixture of DMSO and NMP in a weight ratio of 1:0.1. The weight ratio of polar solvent and extract in the step of pretreatment is 0.2:1. The resulted mixture at a temperature of 100° C. was filtered through a metal filter having a pore size of not more than 20 μm.

The filter was loaded into the heated cylindrical underflow apparatus for full stratifying at a temperature of 100° C. After dividing the heavy phase was separated and sent to the regeneration of the polar solvent, the light phase was sent to the additional treatment of the extract with the polar solvent.

The thus treated extract (without solvent separation) was further refined by the extraction method according to Example 1 with a mixture of dimethyl sulphoxide and N-methylpyrrolidone in the weight ratio of 0.1:1 in the extraction column under the following conditions: the temperature of the column bottom is 115° C., the weight ratio of polar extract and extract in the pretreatment step is 1.8:1, the total weight ratio of polar extract and extract in the pretreatment step and additional treatment step is 1.9:1. The polar solvent was separated from the non-carcinogenic aromatic process oil by the distillation method at a lower pressure (pressure 5 mbar, temperature 180° C.). The produced non-carcinogenic aromatic process oil was analyzed for the content of a PCA extract and the content of aromatic carbon $C_a$.

For the time of the continuous operation (during a month) an inconsiderable formation of an intermediate layer was noticeable, no decreasing the dosages was required.

The results of additional treatment of the extract with polar solvents are given in Table 1.

EXAMPLES 3-6

The process of preparation and additional treatment was carried out according to Example 2 of the description. The weight ratio of dimethyl sulphoxide and N-methylpyrrolidone in the mixer was varied within the range of 1:0.08-0.6. The results of refining the extract with polar solvents are given in Table 1.

TABLE 1

| Example | Composition of polar solvent DMSO/NMP | Polar solvent/extract ratio in additional treatment | Yield of non-carcinogenic aromatic process oil, % | PCA extract content, % | Content of aromatic carbon Ca, % |
|---|---|---|---|---|---|
| 1 (comparative) | 1:0 | 2.0:1 | 90 | 3.2 | 27.8 |
| 2 | 1:0.1 | 1.8:1 | 89 | 2.9 | 27.4 |
| 3 | 1:0.08 | 1.8:1 | 90 | 3.1 | 27.8 |
| 4 | 1:0.3 | 1.8:1 | 88 | 2.7 | 26.5 |
| 5 | 1:0.5 | 1.8:1 | 87 | 2.7 | 25.9 |
| 6 | 1:0.6 | 1.8:1 | 85 | 2.7 | 24.6 |

As seen from Table 1, when the dimethyl sulphoxide:N-methylpyrrolidone ratio in the mixture is less than 1:0.1 the resulted product does not meet the requirements for the indicator "the PCA extract content" according to the IP-346 method and is more than 3.0% (Example 3). When the dimethyl sulphoxide and N-methylpyrrolidone ratio in the mixture is more than 1:0.5 (Example 6) the extraction selectivity of polycyclic aromatic hydrocarbons reduces, consequently the carbon content of aromatic ring of less than 25% resulting thereby in deteriorating the properties of vulcanized rubbers of butadiene-styrene rubber (in particular, deteriorating protector coupling with wet asphalt), as well as the yield of final product decreases. In the prototype example a step of preliminary preparation of the extract is absent and the extraction column gradually is blocked with mechanical impurities.

EXAMPLES 7-11

The process of preparation and additional treatment of the extract was carried out according to Example 2. The weight ratio of polar solvent and extract in the additional treatment step was varied within the range of 1.4-2.6:1.

The results of refining the extract with polar solvents are given in Table 2.

| Example | Composition of polar solvent DMSO/NMP | Polar solvent/extract ratio in additional treatment | Yield of non-carcinogenic aromatic process oil, % | PCA extract content, % | Content of aromatic carbon Ca, % |
|---|---|---|---|---|---|
| 7 | 1:0.2 | 1.4:1 | 90 | 3.2 | 28.0 |
| 8 | 1:0.2 | 1.5:1 | 89 | 2.9 | 27.8 |
| 9 | 1:0.2 | 1.8:1 | 89 | 2.7 | 26.8 |
| 10 | 1:0.2 | 2.5:1 | 87 | 2.5 | 25.5 |
| 11 | 1:0.2 | 2.6:1 | 86 | 2.3 | 24.5 |

As seen from Table 2, when the polar solvent:extract ratio in the mixture in the pretreatment step is less than 1.4:1, the resulted product does not meet the requirements for "the PCA extract content" according to the IP-346 method and is more than 3.0%/o (Example 7). When the polar solvent: extract ratio in the additional treatment step is more than 2.5:1 (Example 11) the extraction selectivity of polycyclic aromatic hydrocarbons reduces.

EXAMPLES 12-16

The method was carried out according to Example 2. The weight ratio of polar solvent and extract in the pretreatment step was varied within the range of 0.07-0.4:1. The process of preparation and additional treatment of the extract was carried out according to Example 2 of the description.

The total weight ratio of polar extract and extract in the pretreatment step and additional treatment step is 1.9:1. In Example 12 the polar solvent was fully mixed with the extract, the flotation of impurities did not occur. The formation of an intermediate layer in an extraction column is noticeable. The results of treating the extract with polar solvents are given in Table 3.

TABLE 3

| Example | Polar solvent/extract ratio in pretreatment | Polar solvent/extract ratio in additional treatment in column | Yield of non-carcinogenic aromatic process oil, % | The presence of intermediate layer in the column | PCA extract content, % | Content of aromatic carbon $C_a$ |
|---|---|---|---|---|---|---|
| 12 | 0.07:1 | 1.83:1 | 89 | Yes | 3.1 | 28.0 |
| 13 | 0.1:1 | 1.8:1 | 89 | No | 2.9 | 27.4 |
| 14 | 0.2:1 | 1.7:1 | 89 | No | 2.8 | 27 2 |
| 15 | 0.3:1 | 1.6:1 | 87 | No | 2.8 | 26.8 |
| 16 | 0.4:1 | 1.5:1 | 86 | No | 3.1 | 26.0 |

According to Examples 12-16 it is apparent when the polar solvent and extract ratio reduces below 0.1:1 in the pretreatment step (Example 12) no coagulation and flotation of contaminations take place, consequently contaminations come to the extraction column, an intermediate layer appears in the column deteriorating the extraction process. When the polar solvent and extract ratio increases above 3.0:1 in the pretreatment step the selectivity of the process (the content of aromatic carbon decreases, the content of PCA extract rises), the yield of final product and the quality thereof (Example 16) reduce.

EXAMPLE 17

Comparative

The process of refining the extract is carried out according to Example 2 of the description. As a selective solvent dimethyl sulphoxide having a water content of 2% wt. was used. The results of refining the extract with polar solvents are given in Table 4.

EXAMPLE 18

The process of refining the extract is carried out according to Example 2 of the description. As a selective solvent a mixture consisting of dimethyl sulphoxide (85% wt), N-methylpyrrolidone (13%) and water 2% wt was used. The results of refining the extract with polar solvents are given in Table 4.

TABLE 4

| Example | Composition of polar solvent DMSO/NMP | Polar solvent/extract ratio in additional treatment | Yield of non-carcinogenic aromatic process oil, % | PCA extract content, % | Content of aromatic carbon $C_a$, % |
|---|---|---|---|---|---|
| 17 | 98/0/2 | 1.8/1 | 90 | 3.5 | 28.2 |
| 18 | 85/13/2 | 1.8/1 | 89 | 2.8 | 27.5 |

When the dimethyl sulphoxide:N-methylpyrrolidone ratio is more than 1:0.5 the density difference of the selective solvent and extract a driving motive for the extraction process in a column extractor decreases, as the flow rate and, therefore, the agitating intensity reduce. The process selectivity decreases, as N-methylpyrrolidone has a higher dissolvability than dimethyl sulphoxide, and lower selective dissolubility to polycyclic aromatic hydrocarbons, therefore, the product yield decreases, the content of aromatic carbon lowers and, consequently, the compatibility with rubbers reduces. When the content of N-methylpyrrolidone is lower than 10%, the refining process compared to the prototype does not improve (Example 3).

The weight ratio of the polar solvent and the extract in the additional treatment step is in the range of from 1.5 to 2.5:1. When the ratio of polar solvent and extract is lower than 1.5:1, refining from polycyclic aromatic hydrocarbons is more than 3.0% according to the IP-346 and the produced refined petroleum does not meet the requirements of the REACH European Union Directive. When the polar solvent and extract ratio is more than 2.5:1, the content of aromatic carbon according to the ASTM D 2140 declines, above that the energy demands for regeneration of solvents from an extraction solution rise and the capacity of the extraction column declines.

The weight ratio of the polar solvent and the extract in the step of pretreatment is in the range of from 0.1 to 0.3:1. When the ratio of polar solvent and extract is lower than 0.1:1, no coagulation of impurities takes place as a consequence of forming a homogenous solution and the absence of a two-phase system. When the polar solvent and extract ratio is more than 0.3:1, the energy demands for regeneration of solvents increase.

Thus, proposed is a new more efficient method for producing non-carcinogenic aromatic process oil having a content of PCA extract of less than 3.0% according to the IP-346 and a content of aromatic carbon according to the ASTM D 2140 of at least 25% suitable for use in mixtures with rubbers and RTA if reducing the energy demands of the refining process.

The purpose of preventing getting mechanical contaminations into the column improving the plant capacity for producing a non-carcinogenic aromatic process oil is achieved.

Introducing a pretreatment step and using a mixture of dimethyl sulphoxide and N-methylpyrrolidone allow lowering the polar solvent:extract ratio compared to the prototype method declining thereby the energy demands in the step of regenerating, stripping the solvent, improving the performance of the extraction step without complicating and appreciating the column contact devices, increasing the time of continuous operation of the column without cleaning the column contact devices and pump equipment declining thereby the specific production unit expenses, as well as expenditures for cleaning, washing and repairing the equipment.

Also the method allows reducing the energy demands in the step of drying a solvent by reducing the reflux ratio and residence time of the solvent in the rectification column, as for extraction a solvent having a water content of more than 1% may be used.

For ones skilled in the art other embodiments of the invention may be apparent without changing the substance thereof as it is disclosed in the present description. Accordingly, the invention should be regarded as limited in the scope only to the following claims.

The invention claimed is:

1. A process for producing non-carcinogenic aromatic process oil containing less than 3.0% of a PCA extract according to method IP-346, the process comprising the steps of:

(a) refining a petroleum oil fraction with a solvent and extracting residual and distillate extracts from the refined fraction;

(b) mixing the residual and distillate extracts with a polar solvent comprising a mixture of dimethyl sulphoxide and N-methylpyrrolidone, wherein a weight ratio of dimethyl sulphoxide to N-methylpyrrolidone is in a range of 1:0.1-0.5;

(c) filtering a mixture of the extracts and the polar solvent formed in step (b) to provide (i) a light fraction comprising partially refined petroleum oil extracts and (ii) a heavy fraction comprising an extraction solution;

(d) treating the light fraction with the polar solvent to produce a raffinate; and (e) regenerating the polar solvent with use of the heavy fraction.

2. The process according to claim 1, wherein a weight ratio of the polar solvent to the light fraction in step (d) is within a range of 1.5-2.5:1.

3. The process according to claim 1, wherein a weight ratio of the polar solvent to the residual and distillate extracts in step (b) is within a range of 0.1-0.3:1.

* * * * *